US009869071B1

(12) United States Patent
Mohrfeld

(10) Patent No.: US 9,869,071 B1
(45) Date of Patent: Jan. 16, 2018

(54) METHOD FOR INSTALLING A PILE

(71) Applicant: Austin T. Mohrfeld, Tomball, TX (US)

(72) Inventor: Austin T. Mohrfeld, Tomball, TX (US)

( * ) Notice: Subject to any disclaimer, the term of this patent is extended or adjusted under 35 U.S.C. 154(b) by 0 days.

(21) Appl. No.: 15/289,159

(22) Filed: Oct. 8, 2016

(51) Int. Cl.
*B63B 21/26* (2006.01)
*E02D 7/06* (2006.01)
*E02D 5/24* (2006.01)
*E02D 27/52* (2006.01)

(52) U.S. Cl.
CPC ..... *E02D 7/06* (2013.01); *E02D 5/24* (2013.01); *E02D 27/525* (2013.01)

(58) Field of Classification Search
CPC .. E02B 17/00; E02B 17/02; E02B 2017/0078; E02D 27/24; E02D 5/40; E02D 27/525; E02D 2250/0053; E02D 27/52; B63B 21/24; B63B 21/27; B63B 21/26
USPC .... 166/356, 367, 244.1, 352, 366, 381, 358; 175/5, 10; 405/224, 195.1, 227, 228, 405/231, 232
See application file for complete search history.

(56) References Cited

U.S. PATENT DOCUMENTS 4,102,147 A * 7/1978 Jansz ..... E02D 13/04 173/DIG. 1
4,257,721 A 3/1981 Haynes
4,318,641 A * 3/1982 Hogervorst ..... B63B 21/27 114/296
4,367,800 A * 1/1983 Arentsen ..... E02D 7/10 173/127
4,558,744 A * 12/1985 Gibb ..... E21B 33/037 166/222
5,951,207 A * 9/1999 Chen ..... E02D 7/02 405/228
6,354,767 B1 * 3/2002 Jones ..... E02D 13/04 405/228
6,659,182 B1 * 12/2003 Saugier ..... E21B 7/205 166/358
6,719,496 B1 * 4/2004 Von Eberstein ..... B63B 21/22 114/296
6,910,831 B2 6/2005 Raines
7,770,655 B2 * 8/2010 Wilde ..... E21B 7/124 166/352
7,934,561 B2 5/2011 Ormond
8,021,082 B2 9/2011 Thomas et al.
8,033,756 B2 10/2011 Adamson
2002/0122696 A1 9/2002 Veselis
(Continued)

*Primary Examiner* — Benjamin F Fiorello
*Assistant Examiner* — Edwin J Toledo-Duran
(74) *Attorney, Agent, or Firm* — Andrew W. Chu; Craft Chu PLLC

(57) ABSTRACT

The system and method for installation includes lowering a pile from a surface to an ocean floor and partially embedding the pile. An installation pile is lowered onto the pile and partially embedding over and around the pile. The installation pile is sealed, and water is pumped from the installation pile to embed the installation pile to a set depth and to form a pressurized zone within the installation interior volume. The set depth corresponds to a hydraulic cylinder in the installation pile being made adjacent to the pile. The hydraulic cylinder actuates to embed the pile to an anchor depth, which is the desired depth of the installation. Water is pumped back into the installation pile to release the pressurized zone and to lift the installation pile from the set depth. The installation pile can return to a vessel at a surface.

20 Claims, 3 Drawing Sheets

(56) References Cited

U.S. PATENT DOCUMENTS

| | | | | |
|---|---|---|---|---|
| 2009/0129870 | A1* | 5/2009 | Jones | E02D 7/16 405/228 |
| 2009/0297276 | A1* | 12/2009 | Foo | B63B 21/27 405/224 |
| 2012/0003048 | A1* | 1/2012 | Hosoy | B63B 21/27 405/172 |
| 2013/0183876 | A1 | 1/2013 | Hosoy et al. | |

* cited by examiner

METHOD FOR INSTALLING A PILE

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a pile for anchoring an offshore installation. More particularly, the present invention relates to a method of embedding a pile with a hydraulic cylinder. Even more particularly, the present invention relates to a method of embedding a pile with a hydraulic cylinder in an installation pile over the pile.

2. Description of Related Art Including Information Disclosed Under 37 CFR 1.97 and 37 CFR 1.98

A suction pile (also known as a suction caisson, a suction anchor, and a suction bucket) is used to moor a subsea drilling rig to the ocean floor. The suction pile is attached to the ocean floor, and rig structures are anchored to the attached suction pile. The suction pile is comprised of a generally tubular body, dropped into the water and floated down to the ocean floor. The open end of the tubular body embeds into the ocean floor, like an upside down bucket faced down in the soil. There is a closed end of the tubular body with a vent hatch. The vent hatch has an opened position and a closed position, and a remote operated vehicle (ROV) is used to move the vent hatch between these two positions. The opened position is used during deployment to the ocean floor, with water flowing through the tubular body by the vent hatch. Once landed, the closed position is used to seal the suction pile, so that air and water remaining in the tubular body are pumped out. Soil of the ocean floor is sucked into the tubular body, solidly embedding the suction pile onto the ocean floor. The embedded and filled suction pile forms a solid base for mooring a drilling rig structures. Suction piles as anchoring means for rigs and other oil and gas exploration installations are known.

There are known methods for installing suction piles, which incorporate the step of embedding the suction pile by landing on the ocean floor and relying on weight for the initial depth of embedding.

U.S. Pat. No. 4,257,721, issued to Haynes on 24 Mar. 1981, discloses a system for placement of piles into the seafloor. After initially embedding, a pressure differential is created so that hydraulic cylinder actuates to further embed the suction pile to the desired depth.

U.S. Pat. No. 4,318,641, issued to Hogervorst on 9 Mar. 1982, describes the suction pile embedding again, but includes steps for retrieving components of the system. The suction pile is lowered and embeds by weight, then a pump is lowered and attached to further embed the suction pile to the desired depth. The pump can be retrieved from the suction pile.

U.S. Pat. No. 6,659,182, issued to Saugier et al. on 9 Dec. 2003, discloses a retrievable chamber assembly for casing. The casing and chamber assembly are deployed together, and the chamber assembly is released, after the casing is embedded to the desired depth. Since the casing has no sealable end, the pressure differential in the chamber assembly lowers the casing to the desired depth.

U.S. Patent Publication No. 2012/0003048, published for Hosoy et al. on 5 Jan. 2012 describes another use of overpressure for casing. The same type of chamber assembly is being used to lower casing to a desired depth.

These prior art systems are still limited by the amount of embedding by weight of the suction pile. The soil plug within the suction pile can be a limiting factor for how deep the suction pile can be set, after the initial embedding by weight. If the soil plug is too large, than the negative pressure of the more limited volume between the soil plug and the top of the suction pile may not be able to lower the suction pile to the correct depth. Also, there is no option to raise the suction pile, if embedding by weight is too deep. The negative pressure of the prior art is only lowering the suction pile, not raising the suction pile.

There is also a need to stabilize the soil plug for secure installation. Disrupting the anchoring soil affects the stability of installation at the particular depth. Even when the depth is correct, the stability at that depth may be affected by quality of the soil plug and soil around the soil plug. The application of more and more pressure to install at a particular depth can liquefy the soil, resulting in an unstable anchoring, even though the correct depth is reached. There is a need to be able to reach the proper depth with less pressure.

There are known methods to incorporate a hydraulic cylinder with installation of a suction pile so that less pressure is used to lower the suction pile. In shallow water, the entire suction pile is a hydraulic cylinder. Once embedded by weight, a piston within the suction pile pulls upward for additional suction and embedding, according to U.S. Pat. No. 8,021,082, issued to Thomas et al. on 20 Sep. 2011. Even with less pressure over the area of the suction pile, the problem of the initial embedding by weight persists. The entire suction pile as a hydraulic cylinder does not address the concerns for adjustments after initially embedding. In deep water, there is a hammer, and the suction pile is lowered by striking the suction pile by a hammer raised by hydraulic cylinder and dropped on the suction pile, according to U.S. Pat. No. 8,033,756, issued to Adamson on 11 Oct. 2011. The mechanical hammer creates additional problems of alignment and precision. A suction pile may be hammered unevenly for a skewed anchoring. Each hammering action can be unpredictable. Hitting a "soft patch" could result in hammering to low, and there would be no way to "unhammer" with the available components in these prior art systems.

There are also known methods that retrieve components after installing suction piles. As permanent anchors, the suction pile remains subsea. Re-using the components to install the suction pile is desirable for efficiency and costs. Prior art references rely on a remote operated vehicle (ROV) to transport needed components subsea in order to install suction piles. U.S. Pat. No. 6,719,496, issued to Von Eberstein on 13 Apr. 2004, teaches remote operated vehicles (ROV) in the context of installing suction piles. The suction pile has vents, which can be actuated by the ROV. Additionally, the ROV provides the pump assemblies and motors to the subsea location or connects a pump assembly from the surface to the suction pile.

U.S. Patent Publication No. 2002/0122696, published for Sokol et al. on 5 Sep. 2002 only covers a detachable ROV lowered to the subsea location with the suction pile. Once the pump and motors of the ROV actuate vents and pump water, the ROV can be released from the installed suction pile.

It is an object of the present invention to provide a method for installing a pile.

It is another object of the present invention to provide a method for installing a pile for any amount of initial embedding by weight.

It is another object of the present invention to provide a method for installing a pile and maintaining stability of the soil plug.

It is still another object of the present invention to provide a method for installing a pile for any amount of soil plug from initial embedding by weight.

It is still another object of the present invention to provide a method for installing a pile and reducing the amount of pressure needed to lower the pile after initial embedding by weight.

It is an object of the present invention to provide a method for installing a pile with retrievable components.

These and other objectives and advantages of the present invention will become apparent from a reading of the attached specification.

BRIEF SUMMARY OF THE INVENTION

Embodiments of the system and method of the present invention install piles, such as suction piles, tubular members, and casings, at subsea locations. The present invention installs the pile at the desired depth, or anchor depth, from any initial depth by partial embedding by weight of the pile and preserves the stability of the soil plug. The method for installation includes lowering a pile from a surface to an ocean floor and partially embedding the pile to an initial depth based on weight of the pile. The vertical orientation of the pile is confirmed, then an installation pile is lowered onto the pile. The installation pile partially embeds to an initial installation depth based on weight of the installation pile. The installation pile is embedded around the pile. The installation pile can be comprised of a generally cylindrical installation body having a top installation surface with installation vent valves on a closed end and an installation skirt on an opened end. When partially embedded, the installation pile has an initial installation soil plug and initial installation interior volume within the cylindrical installation body. The pile has its own soil plug and interior volume. The installation soil plug includes the soil plug of the pile, and the initial installation interior volume includes the interior volume and the plug, when the installation pile is lowered onto the pile. There is a hydraulic cylinder mounted in the installation interior volume of the installation pile. The hydraulic cylinder has a piston on a distal end and a connection port on a proximal end.

Then, the installation pile is sealed, usually by closing the installation vent valves. Water is pumped from the initial installation interior volume so as to embed the installation pile to a set depth and to form a pressurized zone within the installation interior volume. The set depth corresponds to the hydraulic cylinder being adjacent to the pile. For example, the piston in the distal end contacts the pile. The method further comprises embedding the pile to an anchor depth with the piston adjacent the pile. The pile moves from the initial depth in the pressurized zone within the installation interior volume to the anchor depth by the piston. The anchor depth corresponds to the desired depth for setting the pile permanently in the ocean floor. The pile is now in position, and the method includes retrieving components of the system for reuse, such as installing another pile.

The method further comprises pumping water back into the installation pile so as to remove the pressurized zone, after the pile is at the anchor depth. In some embodiments, the newly filled installation pile converts the pressurized zone into an equalized zone in the installation interior volume. The water in the installation zone lifts the installation pile from the set depth, and the installation pile can be returned to a vessel at a surface.

Embodiments of the present invention include the installation pile being comprised of a conical sheath within the cylindrical installation body and a tubular cavity extending from a top of the conical sheath and through the top installation surface. With the tubular cavity, the pile is aligned with the tubular cavity and removable inserted into the tubular cavity. The hydraulic cylinder can be mounted in the tubular cavity, such that the step of embedding the pile includes extending the piston from the tubular cavity.

The system can also include a first remotely operated vehicle (ROV). The first ROV can open and close the installation vent valves on the installation pile. Water can fill the installation interior volume when partially embedding with the installation vent valves open. The installation vent valves can be closed when sealing the installation pile and pumping water out of the installation interior volume to form the pressurized zone. The first ROV can have a separate pump for removable connection to the installation pile, and the pump moves the water in and out of the installation pile. Other embodiments of the present invention include a second remotely operated vehicle (ROV) removably attached to the connection port of the hydraulic cylinder. The second ROV can pump fluid through the connection port in order to actuate the piston of the hydraulic cylinder. The second ROV sets the pile to the anchor depth by lowering the piston by a controlled amount.

Embodiments of the present invention further comprise retrieving components of the system. After the pile is set at the anchor depth, the second ROV releases from the hydraulic cylinder. The first ROV releases from the installation pile, after the step of pumping water back into the installation pile to lift the installation pile from the set depth. The installation pile is separated from the initial installation soil plug and can be floated to a vessel at the surface. The installation pile, the first ROV, the second ROV, and all pumps carried by the ROVs are returned to the vessel for another installation.

DETAILED DESCRIPTION OF THE INVENTION

A suction pile is comprised of a generally cylindrical body having a top surface with vent valves on a closed end and a skirt on an opened end. The known installation of the suction pile includes opening the vent valves as the suction pile is lowered to the ocean floor and partially embedding the pile to an initial depth based on weight of the pile. The pile has an initial soil plug within the cylindrical body and an initial interior volume. The vent valves being open during the step of partially embedding the pile fills the initial interior volume with water. The vent valves are then closed, and water is pumped from the initial interior volume, which creates negative pressure in the cylindrical body. Additional soil is suctioned into the cylindrical body, lowering the suction pile from the initial depth based on weight to the desired depth. Suctioning more soil decreases the stability of the soil and the stability of the suction pile at the desired depth. Additionally, the initial depth appears to limit the desired depth of the suction pile because the initial interior volume determines the amount of negative pressure to lower the suction pile. Other types of piles, such as foundation piles, conductor piles, casings, and other tubular members, may not have the closed end, such that another type of installation is required.

FIGS. 1-9 disclose embodiments of the system and method of the present invention to install piles, including foundation piles and others, at subsea locations. The present invention installs the pile at the desired depth, or anchor depth, with an installation pile, a type of suction pile. Any pile at an initial depth by partial embedding by weight of the pile can be set to the desired depth, or anchor depth, while preserving the stability of the soil plug. The system 10 and method for installation disturbs less soil by eliminating suctioning of the soil into the pile when moving from the initial depth to the anchor depth.

Figure 1:
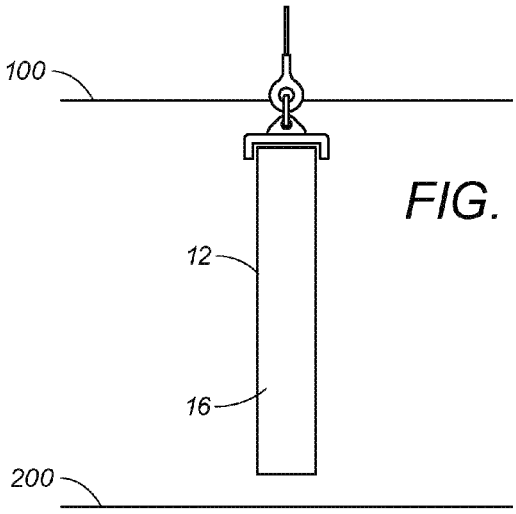
FIG. 1 is a schematic view of the pile being lowered from a surface to an ocean floor.
Figure 2:
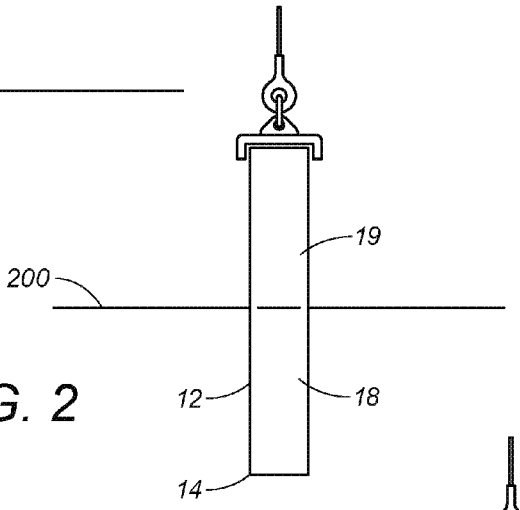
FIG. 2 is a schematic view of the pile being partially embedded to an initial depth.

The system 10 and method for installation are shown in FIGS. 1-2 as lowering a pile 12 from a surface 100 to an ocean floor 200 and partially embedding the pile 12 to an initial depth 14 based on weight of the pile 12. The pile 12 is comprised of a cylindrical body 16. The pile 12 can be a suction pile with generally cylindrical body 16 having a top surface at a closed end and a skirt on an opened end or a foundation pile without any closed end. Other piles and tubular members can be a pile 12 of the present invention.

Figure 3:
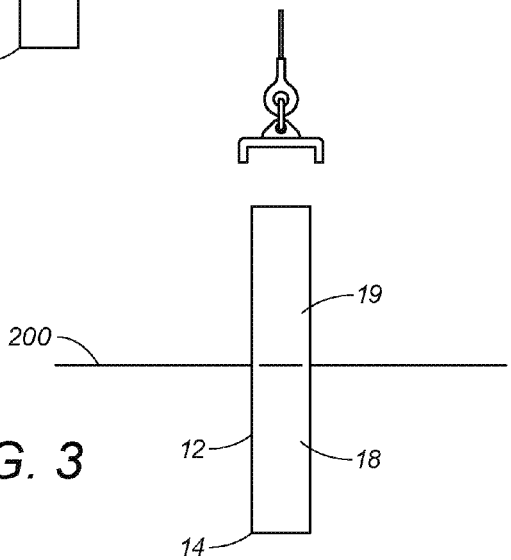
FIG. 3 is a schematic view of confirming vertical orientation of the pile.

FIG. 3 shows the pile 12 at the initial depth 14 by weight. The vertical orientation of the pile 12 is confirmed so that the installation can proceed. There is an initial soil plug 18 and an initial interior volume 19 within the cylindrical body 16. The initial interior volume 19 may or may not be sealed. The initial soil plug 18 stabilizes the pile 12 at the initial depth 14.

Figure 4:
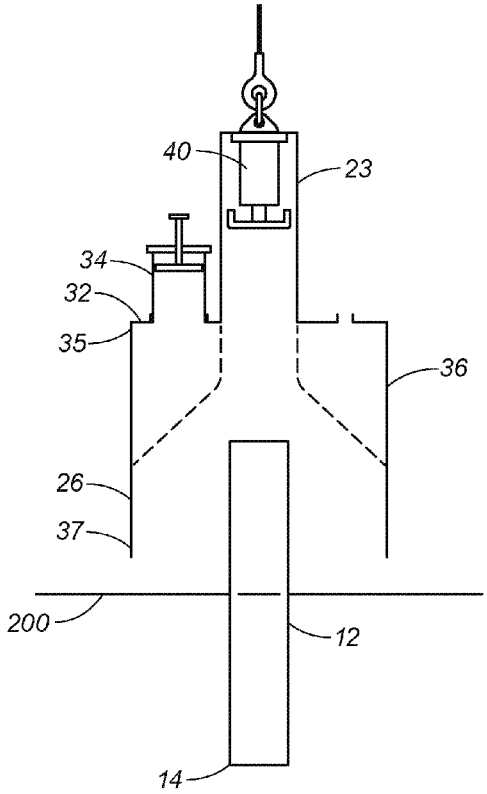
FIG. 4 is a schematic view of the installation pile being lowered onto the pile.
Figure 5:
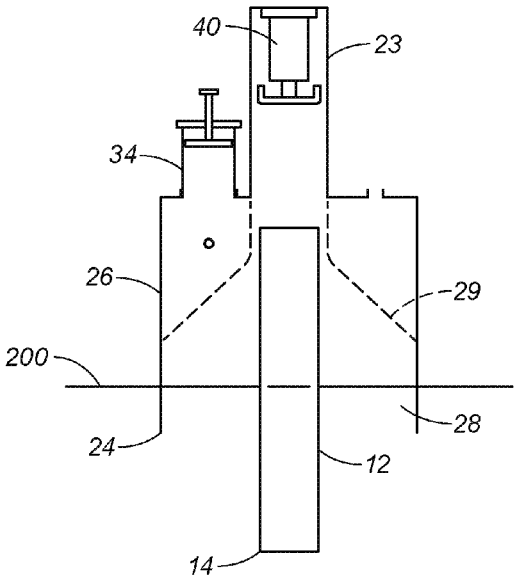
FIG. 5 is a schematic view of the installation pile being partially embedded to an initial installation depth.

The system 10 and method further comprises lowering an installation pile 22 onto the pile 12. The installation pile 22 also partially embeds to an initial installation depth 24 based on weight of the installation pile 22; however, the installation pile 22 is embedded around the pile 12. FIG. 4 shows the installation pile 22 comprised of a generally cylindrical installation body 26 having a top installation surface 32 with installation vent valves 34 on a closed end 35 and an installation skirt 36 on an opened end 37. When partially embedded in FIG. 5, the installation pile 22 has an initial installation soil plug 28 and initial installation interior volume 29 within the cylindrical installation body 26. Because the pile 12 has its own soil plug 18 and interior volume 19, the installation soil plug 28 includes the soil plug 18 of the pile 12, and the initial installation interior volume 29 includes the interior volume 19 of the pile 12, when the installation pile 22 is lowered onto the pile 12. The installation skirt 36 is far enough away from the cylindrical body 16 so as to avoid disturbing the soil and soil plug 18 of the pile 12. The pile 12 is within the initial installation interior volume 29 of the installation pile 22. FIGS. 4 and 5 also show a hydraulic cylinder 40 mounted in the initial installation interior volume 29 of the installation pile 22. The hydraulic cylinder 40 has a piston 42 on a distal end 44 and a connection port 46 on a proximal end 48. The pile 12 and the installation pile 22 have an aligned configuration in FIG. 5.

Figure 6:
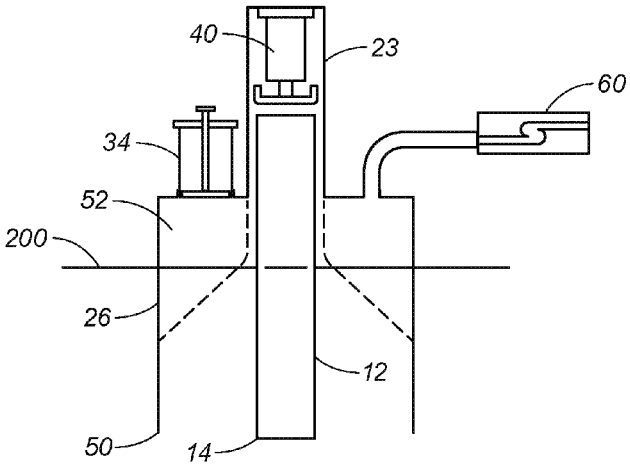
FIG. 6 is a schematic view of pumping water from the installation pile, after the installation pile is sealed, so as to move the installation pile from the initial installation depth to the set depth adjacent the pile.

Embodiments of the system 10 and method include sealing the installation pile 22. For example, the installation vent valves 34 are closed in FIG. 6 for a sealed configuration of the installation pile 22. Water is pumped from the initial installation interior volume 29 so as to embed the installation pile 22 to a set depth 50 and to form a pressurized zone 52 within the installation interior volume 29. Soil is suctioned into the cylindrical installation body 26 to lower the installation pile 22 without disturbing the pile 12 and soil plug 18. The set depth corresponds to the hydraulic cylinder 40 being adjacent to the pile 12. FIG. 6 shows the piston 42 in the distal end 44 contacting the pile 12. The installation pile 22 is now at the set depth 50, and the pile 12 is at the initial depth 14. The installation pile 22 has moved from the initial installation depth 24 to the set depth 50. The pile 12 and the installation pile 22 have an adjacent configuration with the pile 12 abutting the piston 14 and the installation pile 22 at the set depth 50 in FIG. 6.

Figure 7:
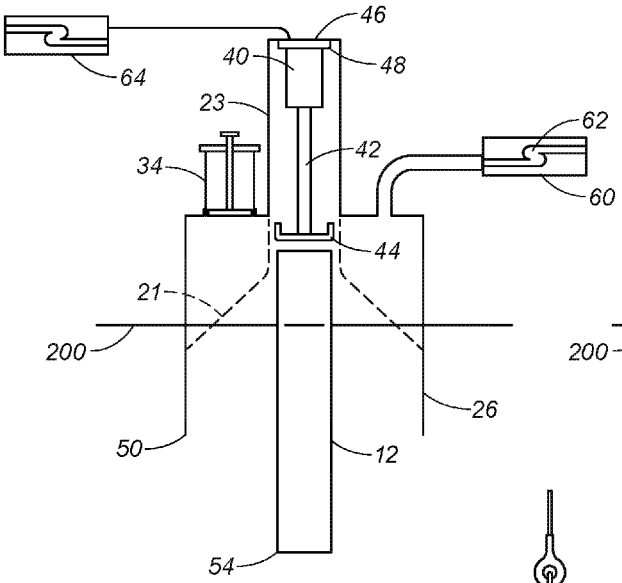
FIG. 7 is a schematic view of the actuation of the piston of the hydraulic cylinder so as to move the pile from the initial depth to the anchor depth.

FIG. 7 shows the method further comprising embedding the pile 12 to an anchor depth 54 with the piston 42 adjacent the pile 12. The pile 12 moves from the initial depth 14 in the pressurized zone 52 within the installation interior volume 29 to the anchor depth 54 by the piston 42. The anchor depth 54 corresponds to the desired depth for setting the pile 12 permanently in the ocean floor. The anchor depth 54 is the preferred depth for stability of the pile 12, including a foundation pile. The anchor depth 54 is independent from the interior volume 19 of the pile 12. The pile 12 can be lower than suctioning from the interior volume 19 would previously allow, when the pile is a suction pile. FIG. 7 shows the pile 12 now in position for permanency and the installation pile 22 at the set depth 50. The pile 12 and the installation pile 22 have an extended configuration with the pile 12 abutting the piston 14, the installation pile 22 at the set depth 50, and the pile 12 at the anchor depth 54 in FIG. 7. The installation pile 22 also has a pressured configuration with the installation vent valves 34 closed, when in the adjacent configuration with the pile 12.

Figure 8:
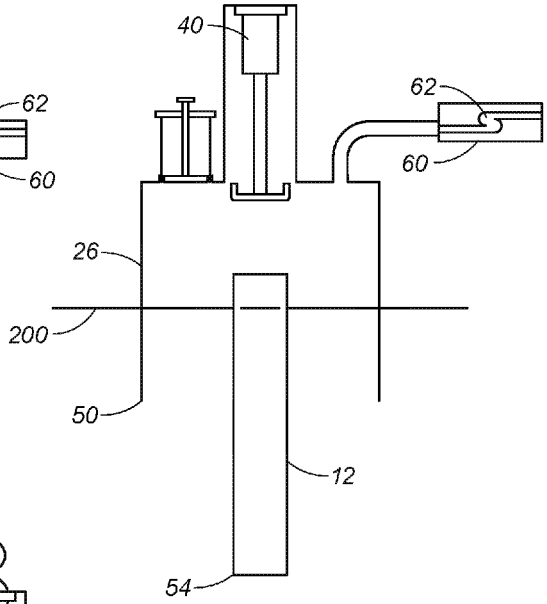
FIG. 8 is a schematic view of pumping water into the installation pile, after the pile reaches the anchor depth, so as to lift the installation pile from the set depth.
Figure 9:
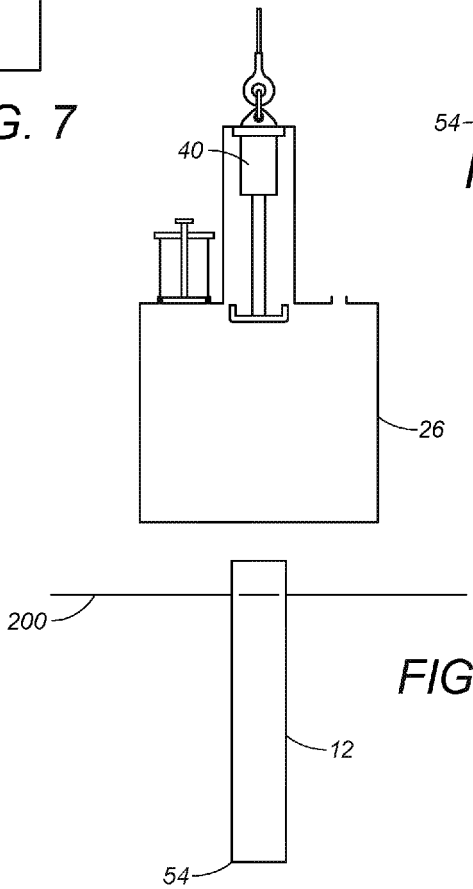
FIG. 9 is a schematic view of the return of the installation pile to the surface, after the ROVs are released and also returned to the surface.

FIG. 8 shows the retrieval of components of the system 10 to be used for installing another pile. Water is pumped back into the installation pile 22. The pressurized zone 52 is replaced, after the pile 12 is at the anchor depth 54. In some embodiments, the newly filled installation pile 22 converts the pressurized zone 52 into an equalized zone 56 in the installation interior volume 29. The installation pile 32 in an equalized configuration is shown in FIG. 8. The water in the installation zone 56 lifts the installation pile 22 from the set depth 50. The step of returning the installation pile 22 to a vessel at the surface 100 is shown in FIG. 9. The installation pile 22 is separated from the pile 22 and from the installation soil plug 28. The installation pile 22 can be floated to the surface 100 by known means.

Embodiments of the system 10 include the installation pile 22 being comprised of a conical sheath 21 within the cylindrical installation body 26 and a tubular cavity 23 extending from a top of the conical sheath 21 and through the top installation surface 32. FIGS. 4-7 show the conical sheath 21 and the tubular cavity 23, such that the pile 12 is aligned with the tubular cavity 23 and removable inserted into the tubular cavity 23. The conical sheath 21 can guide the pile 12 into the tubular cavity 23. The conical sheath 21 is within installation interior volume 29. Structural ribs 25 support the conical sheath 21 in place within the installation pile 22. The embodiment of FIGS. 4-7 show the hydraulic cylinder 40 mounted in the tubular cavity 23. The step of embedding the pile 12 now includes extending the piston 42 from the tubular cavity 23.

The method in FIGS. 4 and 5 show the installation vent valves 34 open during the steps of lower the installation pile 22 and during the step of partially embedding the installation pile 22. Water can fill the initial installation interior volume 29 with the installation vent valves 34 open. The installation vent valves 34 are closed in FIG. 6 in order to seal the initial installation interior volume 34. Embodiments of the system 10 include a first remotely operated vehicle (ROV) 60, as shown in FIGS. 6 and 7. The first ROV 60 closes the installation vent valves 34 on the installation pile 22 for the step of sealing the installation pile 22. The first ROV 60 can also pump water out of the initial installation interior volume 29 in FIG. 6 and maintains the pressurized zone 52 in FIG. 7. The first ROV can have a separate pump 62 for removable connection to the installation pile 32. The pump 62 is on the movable first ROV 60, not the pile 12 or installation pile 22. The pump 62 can be used for other installation piles. The pressurized zone 52 in FIG. 7 is between the installation soil plug 28 and the top installation surface 32. The pressurized zone 52 may or may not match the initial interior installation volume 29. The difference depends upon the initial installation depth 24 and the set depth 50 of the installation pile 32. The pressurized zone 52 is maintained for the step of embedding the pile 12 to the anchor depth 54.

Embodiments of the system 10 include a second remotely operated vehicle (ROV) 64 removably attached to the connection port 46 at the proximal end 48 of the hydraulic cylinder 40. FIG. 7 shows the second ROV 64 actuating the piston 42 of the hydraulic cylinder 40 by pumping fluid through the connection port 46 or otherwise pressurizing the hydraulic cylinder 40. The second ROV 64 lowers the piston 42, and the piston 42 forces the pile 12 to the anchor depth 54 without suctioning soil. The pile 12 is mechanically set by the piston 42. The second ROV 64 is released from the hydraulic cylinder 40 after the pile 12 is at the anchor depth 54 and before water is pumped back into the installation pile 22 by the first ROV 60, as in FIG. 8. The first ROV 60 and the second ROV 64 also return to the vessel at the surface 10 in FIG. 9. The pump 62 or other components to actuate the hydraulic cylinder 40 are mounted on the movable ROVs 60, 64, not permanently attached to the pile 12 or installation pile 22.

The system and method of the present invention installs a pile to a desired depth, or anchor depth. The pile can support plate anchors, rigs, pile structures, and other installations anchored subsea. The pile can self-embed by weight to any initial depth. The initial depth by weight no longer affects the ability to move the pile from the initial depth to the intended anchor depth. The system and method can move a pile from any amount of self-embedding and partial embedding to the desired depth. When the pile must go very deep, the system and method can now reach those depths.

The present invention also strengthens the soil plug of the pile, even when placing the pile at the anchor depth. The installation pile is around the pile and soil plug. Movement of the installation skirt into the soil does not affect the pile and soil plug. The installation soil plug is temporary, but does not interfere with the soil plug at the initial depth or at the anchor depth. The problem of liquefying soil, when suctioning soil into the pile is avoided. Liquefied soil is too fluid and affects stability of the pile at the anchor depth. In the present invention, the suctioned soil of the installation pile is located away from the soil plug of the pile. The amount of pressure on the soil is also reduced. In the prior art suction pile, the amount of force to lower the pile is a factor of pressure and area. The pressure must be very great because the area of the pile is so small. In the present invention, the area of the installation pile is very big relative to the pile, such that the amount of pressure can be much less. Thus, the soil experiences less pressure and less risk of liquefying. The soil for the soil plug remains more stable and improves anchoring at the subsea location.

The present invention also includes retrievable components. The installation pile can be reused for more than one pile. The pile can be a very simple tubular member, and no equipment is lost or abandoned in order to set the pile at the anchor depth. The ROVs also mobilize the pumps and hydraulic power required for the method of the present invention. One ROV can be used for more than installation pile and returned to the vessel. One ROV with a pump could be used for more than one step of the method of the present invention.

The foregoing disclosure and description of the invention is illustrative and explanatory thereof. Various changes in the details of the illustrated structures, construction and method can be made without departing from the true spirit of the invention.

I claim:

1. A method for installation, said method comprising the steps of:

lowering a pile from a surface to an ocean floor, said pile being comprised of a generally cylindrical body;

partially embedding said pile to an initial depth based on weight of said pile, said pile having an initial soil plug and an initial interior volume within the cylindrical body;

confirming vertical orientation of said pile;

lowering an installation pile onto said pile, said installation pile being comprised of a generally cylindrical installation body having a top installation surface with installation vent valves on a closed end, an installation skirt on an opened end, and a hydraulic cylinder, said top installation surface covering said pile;

partially embedding said installation pile to an initial installation depth based on weight of said installation pile, said installation pile having an initial installation soil plug and initial installation interior volume within the cylindrical installation body, said hydraulic cylinder being aligned with said pile;

sealing said installation pile;

pumping water from said installation pile from said initial installation interior volume so as to embed said installation pile to a set depth and form a pressurized zone within said installation interior volume;

embedding said pile to an anchor depth with said hydraulic cylinder having a piston on a distal end and a connection port on a proximal end, said hydraulic cylinder being mounted in said installation interior volume, said piston being adjacent said pile within said installation interior volume and actuated by said hydraulic cylinder, said pile moving from said initial depth in said pressurized zone within said installation interior volume to said anchor depth by said piston;

pumping water back into said installation pile so as to remove the pressurized zone after said pile is at said anchor depth;

lifting said installation pile from said set depth; and returning said installation pile to a vessel at a surface.

2. The method for installation, according to claim 1, said installation pile being further comprised of a conical sheath within the cylindrical installation body and a tubular cavity extending from a top of said conical sheath and through said top installation surface, the step of lowering said installation pile onto said pile further comprising:

aligning said pile with said tubular cavity, said pile being inserted into said tubular cavity.

3. The method for installation, according to claim 2, said hydraulic cylinder being mounted in said tubular cavity, the step of embedding said pile further comprising:

extending said piston from said tubular cavity.

4. The method for installation, according to claim 1, said installation vent valves being open during the step of lowering said installation pile and during the step of partially embedding said installation pile.

5. The method for installation, according to claim 1, further comprising the step of:

filling said initial installation interior volume with water during the step of partially embedding said installation pile.

6. The method for installation, according to claim 1, wherein the step of sealing said installation pile comprises:

closing said installation vent valves of the installation pile.

7. The method for installation, according to claim 1, wherein the step of sealing said installation pile comprises:

closing said installation vent valves of the installation pile with a first remotely operated vehicle (ROV).

8. The method for installation, according to claim 7, wherein the step of pumping water from said installation pile from said initial installation interior volume comprises:

attaching a pump of the first ROV to said installation pile.

9. The method for installation, according to claim 1, wherein said set depth of the step of pumping water from said installation pile corresponds to said piston of said hydraulic cylinder abutting said pile.

10. The method for installation, according to claim 1, wherein said pressurized zone is between said installation soil plug and said top installation surface.

11. The method for installation, according to claim 8, wherein the step of embedding said pile to said anchor depth comprises the step of:

maintaining said pressurized zone with the first ROV;

connecting a second remotely operated vehicle (ROV) to said connection port of said hydraulic cylinder;

pumping fluid through said connection port; and lowering said piston from said distal end.

12. The method for installation, according to claim 11, wherein said pump of the first ROV pumps water back into said installation pile, the method further comprising the step of:

releasing the second ROV from said hydraulic cylinder, after the step of pumping water back into said installation pile.

13. The method for installation, according to claim 1, wherein the step of lifting said installation pile from said set depth further comprises:

separating said initial installation soil plug from the cylindrical installation body.

14. The method for installation, according to claim 11, further comprising the step of:

returning the first ROV and the second ROV to a vessel at a surface.

15. An installation system, comprising:

the pile being comprised of the generally cylindrical body and lowered from a surface to an ocean floor, according to the method of claim 1;

the installation pile being comprised of the generally cylindrical installation body having the top installation surface with installation vent valves on the closed end and the installation skirt on the opened end, said installation pile being removable engaged to said pile, said top installation surface covering said pile;

the hydraulic cylinder mounted within said installation pile, said hydraulic cylinder having the piston on the distal end and the connection port on the proximal end, said hydraulic cylinder being aligned with said pile, wherein said pile and said installation pile have an adjacent configuration with said pile abutting said piston within said installation interior volume, said pile at said set depth, and wherein said pile and said installation pile have an extended configuration with said pile abutting said piston within said installation interior volume, said pile being at said anchor depth;

a first remotely operated vehicle (ROV) removably engaged with said installation pile; and a second remotely operated vehicle (ROV) removably engaged with said hydraulic cylinder through said connection port.

16. The installation system, according to claim 15, wherein said installation pile further comprises:

a conical sheath within the cylindrical installation body; and a tubular cavity extending from a top of said conical sheath and through said top installation surface, wherein said pile and said installation pile having an aligned configuration with said pile aligned with said tubular cavity, and wherein said pile is removably inserted within said tubular cavity.

17. The installation system, according to claim 16, said hydraulic cylinder being mounted in said tubular cavity.

18. The installation system, according to claim 15, wherein said installation vent valves of the installation pile are closed by the first ROV, said installation pile having a sealed configuration, wherein said water in said installation pile is pumped from said installation pile by the first ROV, said installation pile having a pressured configuration, and wherein said pile and said installation pile move from said adjacent configuration to said extended configuration, when said installation pile is in said pressured configuration.

19. The installation system, according to claim 18, wherein said piston being actuated by the second ROV, when said pile and said installation pile move from said adjacent configuration to said extended configuration.

20. The installation system, according to claim 19, wherein the first ROV pumps additional water into said installation pile, said installation pile having an equalized configuration, wherein the second ROV releases from said hydraulic cylinder, when said installation pile is in said equalized configuration after said pressurized configuration, wherein said installation pile separates from said pile when said installation pile is in said equalized configuration after said pressurized configuration, and wherein the first ROV releases from said installation pile, after said installation pile is separated from said pile and the ocean floor.

* * * * *